US006626595B2

(12) United States Patent
Kabamoto

(10) Patent No.: US 6,626,595 B2
(45) Date of Patent: Sep. 30, 2003

(54) AUTOMATIC SHEET-FEEDING DEVICE OF PRINTER

(75) Inventor: Akira Kabamoto, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/880,930

(22) Filed: Jun. 14, 2001

(65) Prior Publication Data

US 2001/0052921 A1 Dec. 20, 2001

(30) Foreign Application Priority Data

Jun. 15, 2000 (JP) ..... 2000-184568

(51) Int. Cl.[7] ..... B65H 3/52

(52) U.S. Cl. ..... 400/624; 400/625; 400/628; 271/117; 271/121

(58) Field of Search ..... 271/120, 121, 271/117, 118; 400/624, 625, 628, 629

(56) References Cited

U.S. PATENT DOCUMENTS 4,097,041 A * 6/1978 Fujimoto ..... 271/110
4,363,477 A * 12/1982 Miyashita ..... 271/117
5,358,230 A * 10/1994 Ikemori et al. ..... 271/114
5,370,380 A * 12/1994 Suzuki et al. ..... 271/117
5,485,991 A * 1/1996 Hirano et al. ..... 271/109
5,655,762 A * 8/1997 Yergenson ..... 271/121
6,059,281 A * 5/2000 Nakamura et al. ..... 271/119
6,199,855 B1 * 3/2001 Choeng et al. ..... 271/122
6,217,017 B1 * 4/2001 Yamazaki ..... 271/121
6,382,621 B1 * 5/2002 Inoue et al. ..... 271/120

FOREIGN PATENT DOCUMENTS

| | | |
|---|---|---|
| JP | 5-39136 | 2/1993 |
| JP | 5-278885 | 10/1993 |
| JP | 2000-143023 | 5/2000 |

* cited by examiner

*Primary Examiner*—Andrew H. Hirshfeld
*Assistant Examiner*—Dave A. Ghatt
(74) *Attorney, Agent, or Firm*—Brinks Hofer Gilson & Lione

(57) ABSTRACT

An automatic sheet-feeding device of a printer includes a sheet loading section, delivery rollers, and a separating plate. When recording sheets placed on the sheet loading section are supplied, the delivery rollers are rotationally driven in contact with the sheet loading section, and the inclination of the separating plate with respect to the surface of the sheet loading section is changed to an angle that allows the uppermost recording sheet to be separated one by one. Except when the recording sheet is supplied from the sheet loading section, the delivery rollers are separated from the sheet loading section, and the separating plate is inclined substantially perpendicularly to the surface of the sheet loading section to hold the recording sheets.

1 Claim, 6 Drawing Sheets

AUTOMATIC SHEET-FEEDING DEVICE OF PRINTER

BACKGROUND OF THE INVENTION

1. Field of the Invention

The present invention relates to an automatic sheet-feeding device of a printer, and more particularly, to an automatic sheet-feeding device of a printer which separates a plurality of stacked recording sheets one by one and subjects the recording sheets to printing.

2. Description of the Related Art

In general, various types of printers, such as thermal transfer printers and ink-jet printers, are used as output devices for computers, word processors, facsimile machines, and the like.

In order to perform desired printing in such printers, a plurality of recording sheets are loaded on a sheet loading section mounted on a printer frame, and are separated and supplied one by one by rotating delivery rollers in contact with the uppermost recording sheet. The recording sheet supplied by the delivery rollers is further conveyed by the rotational force of feeding rollers provided ahead of the printing position in the printer, that is, the feeding rollers take over the role of feeding the recording sheet from the delivery rollers.

As shown in FIG. 6, a printer 101 to which a conventional automatic sheet-feeding device is applied is configured such that printing is performed while a recording sheet 100 is fed substantially vertically. In this printer 101, a platen 104 shaped like a flat plate extends in the widthwise direction of a printer frame 103 so that the surface of the recording sheet 100 to be printed is held substantially vertically. On one side of the printer frame 103, a carriage 105 is disposed so as to be reciprocally moved along the platen 104 by a driving mechanism (not shown). At one end (the right side in FIG. 6) of the carriage 105, a thermal head 123 having an array of heating elements (not shown) is disposed so as to be moved closer to and further apart from the platen 104 by a driving mechanism (not shown).

A ribbon cassette is detachably mounted on the carriage 105. The thermal head 123 is pressed against the platen 104 while the recording sheet 100 and an ink ribbon contained in the ribbon cassette are supplied between the platen 104 and the thermal head 123.

At the center of the printer frame 103, a delivery roller driving shaft 111 extends in the widthwise direction of the printer frame 103 and is supported by the printer frame 103 at both ends. A plurality of delivery rollers 114 are mounted in the axial direction on the delivery roller driving shaft 111 at predetermined intervals.

A cam lever 112 is mounted at the axial end of the delivery roller driving shaft 111 to corotate therewith.

A sheet loading section support shaft 124 is disposed in the upper part of the printer frame 103 on the upstream side in the sheet feeding direction. The sheet loading section support shaft 124 pivotally supports a sheet loading section 125 which has an upper surface functioning as a sheet stacking plate 107 on which a plurality of recording sheets 100 are stacked. When the sheet loading section 125 is pivoted in the sheet feeding direction, the front part of the sheet stacking plate 107 can be pressed against the delivery rollers 114 by an urging means 113 such as a spring member.

A protuberance 126 is formed at the lower end of the sheet stacking plate 107 of the sheet loading section 125. The leading end of the cam lever 112 can either be engaged with or disengaged from the protuberance 126 depending on the rotation of the delivery rollers 114.

A separating plate 120 is disposed below the delivery rollers 114, and the leading edges of the recording sheets 100 placed on the sheet stacking plate 107 make contact with the separating plate 120. The separating plate 120 is inclined at a predetermined angle so that only the uppermost recording sheet 100 is separated.

A feeding roller driving shaft 116 is disposed below the platen 104 and on the side diagonally above the delivery roller driving shaft 111 so as to extend in the widthwise direction and to be supported by the printer frame 103 at both ends. A plurality of feeding rollers 117 are mounted on the feeding roller driving shaft 116 at predetermined intervals. On the side diagonally below the feeding rollers 117, auxiliary rollers 118 are disposed so that they are in contact with the outer peripheral surfaces of the feeding rollers 117 so as to corotate therewith. Between the sheet loading section 125 mounted in the printer frame 103 and the feeding rollers 117, a curved guide plate 119 is formed so as to guide recording sheets 100 supplied from the sheet loading section 125 by the delivery rollers 114 between the feeding rollers 117 and the auxiliary rollers 118 placed on the downstream side in the sheet feeding direction.

On the downstream side of the platen 104 in the sheet feeding direction, a discharge-roller driving shaft 121 rotatably extends in the widthwise direction of the printer frame 103 and is supported by the printer frame 103. A plurality of discharge rollers 122 are mounted on the discharge-roller driving shaft 121 at predetermined intervals so as to discharge recording sheets 100, which have been subjected to printing, outside.

In this way, a recording sheet 100 delivered from the sheet loading section 125 by the delivery rollers 114 is guided by the guide plate 119 and is transferred to the feeding rollers 117 and the auxiliary rollers 118 ahead of the printing position, and is conveyed upward to the printing position while being pinched therebetween. The printed recording sheet 100 is discharged from the printer 101 by the discharge rollers 122.

In the automatic sheet-feeding device of the printer with such a configuration, the upper side of the sheet loading section 125 is pivoted away from the platen 104 against the urging force of the urging means 113 so that the sheet loading section 125 separates from the delivery rollers 114. In this state, recording sheets 100 are placed on the sheet stacking plate 107 while the leading edges thereof slide on the upper surface of the sheet stacking plate 107 from above.

Then, the sheet loading section 125 is pivoted again by the urging force of the urging means 113 so that the sheet stacking plate 107 moves closer to the platen 104, whereby the protuberance 126 of the sheet loading section 125 and the cam lever 112 of the delivery rollers 114 are brought into contact with each other. Subsequently, an automatic sheet supply operation and a printing operation of the printer 101 are started, and only the uppermost recording sheet 100 placed on the sheet stacking plate 107 is conveyed toward the feeding rollers 117 by the rotation of the delivery rollers 114.

The conveyed recording sheet 100 is guided by the guide plate 119 and is transferred between the feeding rollers 117 and the auxiliary rollers 118.

Subsequently, the recording sheet 100 is fed back to the upstream side in the sheet feeding direction by reversely rotating the feeding rollers 117, and is cued up to a printing start position.

After the recording sheet 100 has been cued up to the printing start position, desired printing is performed thereon by pressing the thermal head 123 against the platen 104 with the ink ribbon and the recording sheet 100 therebetween and by selectively driving the heating elements of the thermal head 123 according to printing information, such as image information, while moving the carriage 105 along the platen 104.

In the printer 101 to which the conventional automatic sheet-feeding device is applied, when a plurality of recording sheets are loaded on the sheet stacking plate 107 of the sheet loading section 125, the delivery rollers 114 are separate from the sheet loading section 125.

In this case, the delivery roller driving shaft 111 with the delivery rollers 114 thereon is fixed to the printer frame 103, and the sheet stacking plate 107 is pivoted downward on the sheet loading section support shaft 124. Since reliability of loading the recording sheets 100 is ensured by minimizing the amount of release of the delivery rollers 114 and the sheet stacking plate 107, when approximately twenty to thirty recording sheets 100 are inserted into the sheet stacking plate 107, they abut against the surrounding components, thereby making insertion difficult.

In such a case, in order to load such a large number of recording sheets 100 on the sheet stacking plate 107 more easily, the sheet stacking plate 107 must be manually pressed down.

When the amount of release of the delivery rollers 114 and the sheet stacking plate 107 is increased in order for the recording sheets 100 to be loaded more easily on the sheet stacking plate 107 of the sheet loading section 125, the recording sheets 100 may be inadvertently inserted in the sheet feeding direction through the space formed therebetween.

When the uppermost recording sheet 100 stacked on the sheet stacking plate 107 is subjected to printing, it is conveyed in the sheet feeding direction only by the feeding rollers 117 in a state while the delivery rollers 114 are separate from the sheet loading section 125 in order to increase the sheet feeding accuracy.

Therefore, in such a case where loading is made easier by increasing the amount of release of the delivery rollers 114 and the sheet stacking plate 107, the uppermost recording sheet 100 placed on the sheet stacking plate 107 may slip in the sheet feeding direction although its movement in that direction is limited by the separating plate 120. In particular, when several tens of recording sheets are stacked, such an undesirable result will occur frequently.

SUMMARY OF THE INVENTION

Accordingly, it is an object of the present invention to provide an automatic sheet-feeding device of a printer in which recording sheets can be reliably loaded in a sheet loading section and only the uppermost recording sheet is reliably supplied during a sheet supply operation.

In order to overcome at least one of the above problems, according to an aspect of the present invention, there is provided an automatic sheet-feeding device of a printer including a sheet loading section for holding a plurality of stacked recording sheets to be subjected to printing; a delivery roller movable closer to and further apart from the recording sheets held in the sheet loading section so as to supply the recording sheets in the sheet feeding direction; and a separating plate disposed at the lower end of the sheet loading section so as to allow the leading edges of the recording sheets to contact therewith and to separate the uppermost recording sheet one by one, wherein the delivery roller is rotationally driven while it is in contact with the sheet loading section and the inclination of the separating plate with respect to the surface of the sheet loading section is made large enough to separate the uppermost recording sheet one by one when the recording sheets held in the sheet loading section are supplied, and the delivery roller is separated from the sheet loading section and the inclination of the separating plate with respect to the surface of the sheet loading section is made small enough to hold the recording sheets except when the recording sheets are supplied from the sheet loading section.

In this case, since the separating plate functions as a barrier in the sheet feeding direction when the recording sheets are loaded on the sheet loading section, they will not be inadvertently inserted from the sheet loading section in the sheet feeding direction serving as the inserting direction, and reliability of loading the recording sheets on the sheet loading section can thereby be improved.

Even when several tens of recording sheets are inserted together in the sheet loading section, they do not abut against the surrounding components because space, large enough to hold the recording sheets, is ensured between the sheet loading section and the delivery roller. This also improves reliability of loading the recording sheets.

Preferably, the separating plate is moved in connection with the movement of the delivery roller closer to and further apart from the sheet loading section.

During the operation of printing on a recording sheet, recording sheets remaining on the sheet loading section are limited by the separating plate inclined at a small angle, and therefore, will not be supplied in the sheet feeding direction while overlapping with each other.

Preferably, the automatic sheet-feeding device of a printer further includes a rotation shaft for rotatably supporting the delivery roller, and a lever arm pivotally movable on one end so as to support the rotation shaft at the other end. The lever arm has a retaining portion protruding outward for supporting the separating plate. When the delivery roller performs a sheet supply operation, the separating plate increases its angle of inclination via the retaining portion of the lever arm in connection with the movement of the delivery roller into contact with the recording sheets on the sheet loading section. Except during the sheet supply operation, the separating plate decreases its angle of inclination via the retaining portion of the lever arm in accordance with the movement of the delivery roller further apart from the sheet loading section.

In this case, since the separating plate automatically adjusts its angle of inclination to predetermined angles in accordance with the movement of the delivery roller, troublesome operations and incorrect operations can be avoided.

Further objects, features, and advantages of the present invention will become apparent from the following description of the preferred embodiments (with reference to the attached drawings).

DESCRIPTION OF THE PREFERRED EMBODIMENTS

A printer to which an automatic sheet-feeding device is applied according to an embodiment of the present invention will be described below with reference to FIGS. 1 to 5.

Figure 1:
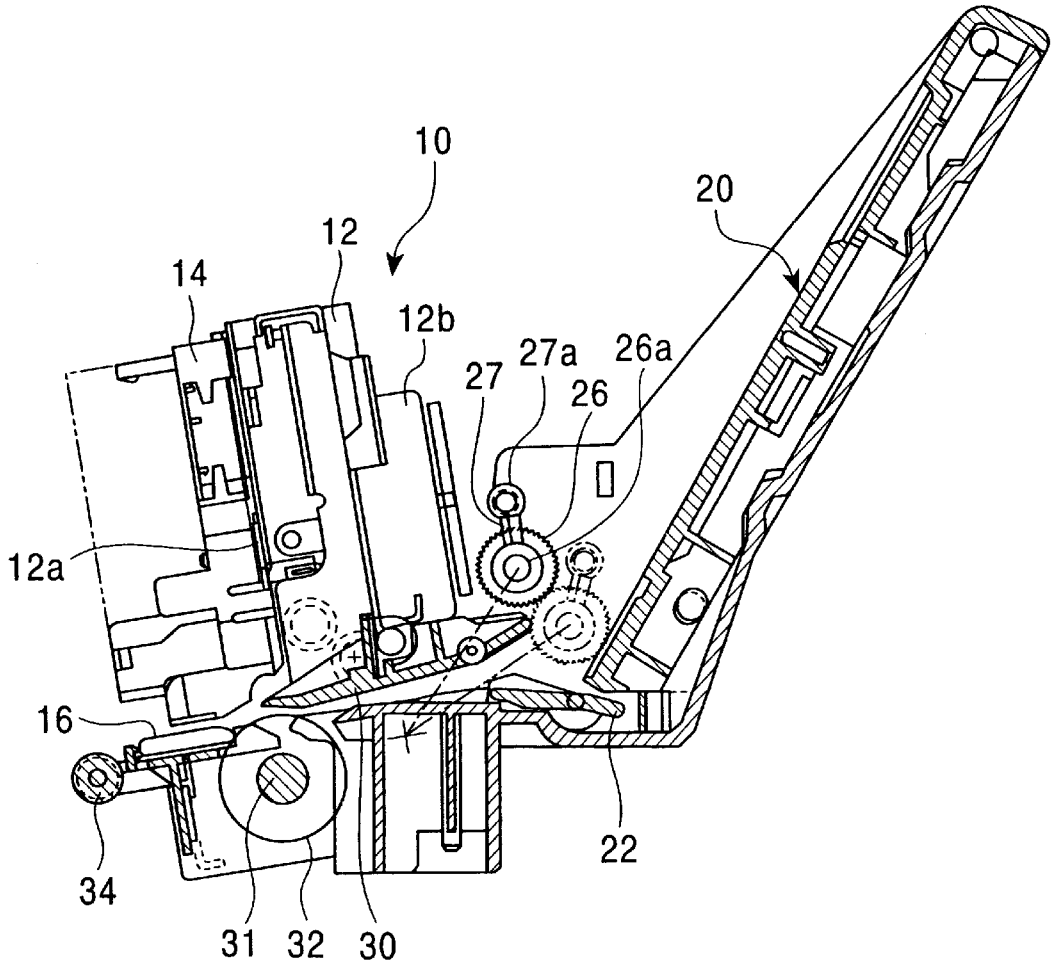
FIG. 1 is a sectional view showing the principal part of an automatic sheet-feeding device of a printer according to an embodiment of the present invention.

Referring to FIG. 1, a printer 10 has a printer frame 12 to be placed inside a printer case (not shown). The printer frame 12 is made of metal in the shape of a rectangular parallelepiped.

On the side of a front portion 12*a* of the printer frame 12, a carriage 14 is disposed so as to be reciprocally movable by a driving mechanism (not shown). A ribbon cassette having an ink ribbon of a desired color wound therein is detachably mounted in the carriage 14.

Below the carriage 14, a platen 16 shaped like a flat plate is pivotally supported in the printer case (not shown) so as to extend in the widthwise direction of the printer frame 12.

A thermal head in which a plurality of heating elements are arranged in an array is disposed at the lower end of the carriage 14. The thermal head is moved closer to and further apart from the platen 16 by a driving mechanism (not shown).

The ink ribbon of the ribbon cassette is guided between the heating elements of the thermal head and the platen 16. By pressing the thermal head having heated heating elements against the platen 16 while the ink ribbon and a recording sheet 100 (see FIG. 2) are placed one on the other between the platen 16 and the thermal head, ink of the ink ribbon is partly transferred onto the recording sheet 100, and printing is thus performed.

A sheet loading section 20 is disposed integrally with a rear portion 12*b* of the printer frame 12 and in a tilting manner. The sheet loading section 20 holds a plurality of stacked recording sheets 100 on its upper surface.

A plurality of rotatable delivery rollers 26 are disposed above the sheet loading section 20 so as to extend in the widthwise direction of the printer frame 12.

A delivery roller driving shaft 26*a* for rotatably supporting the delivery rollers 26 is provided with a small arm 27 which pivotally supports, at one end, the axial end of the delivery roller driving shaft 26*a*. Via a support shaft 27*a* disposed at the other end of the small arm 27, the delivery rollers 26 mounted in the axial direction on the delivery roller driving shaft 26*a* at predetermined intervals are moved in an arc form inside a groove (not shown) of the sheet loading section 20 so as to move closer to and further apart from the upper surface of the sheet loading section 20.

Figure 4:
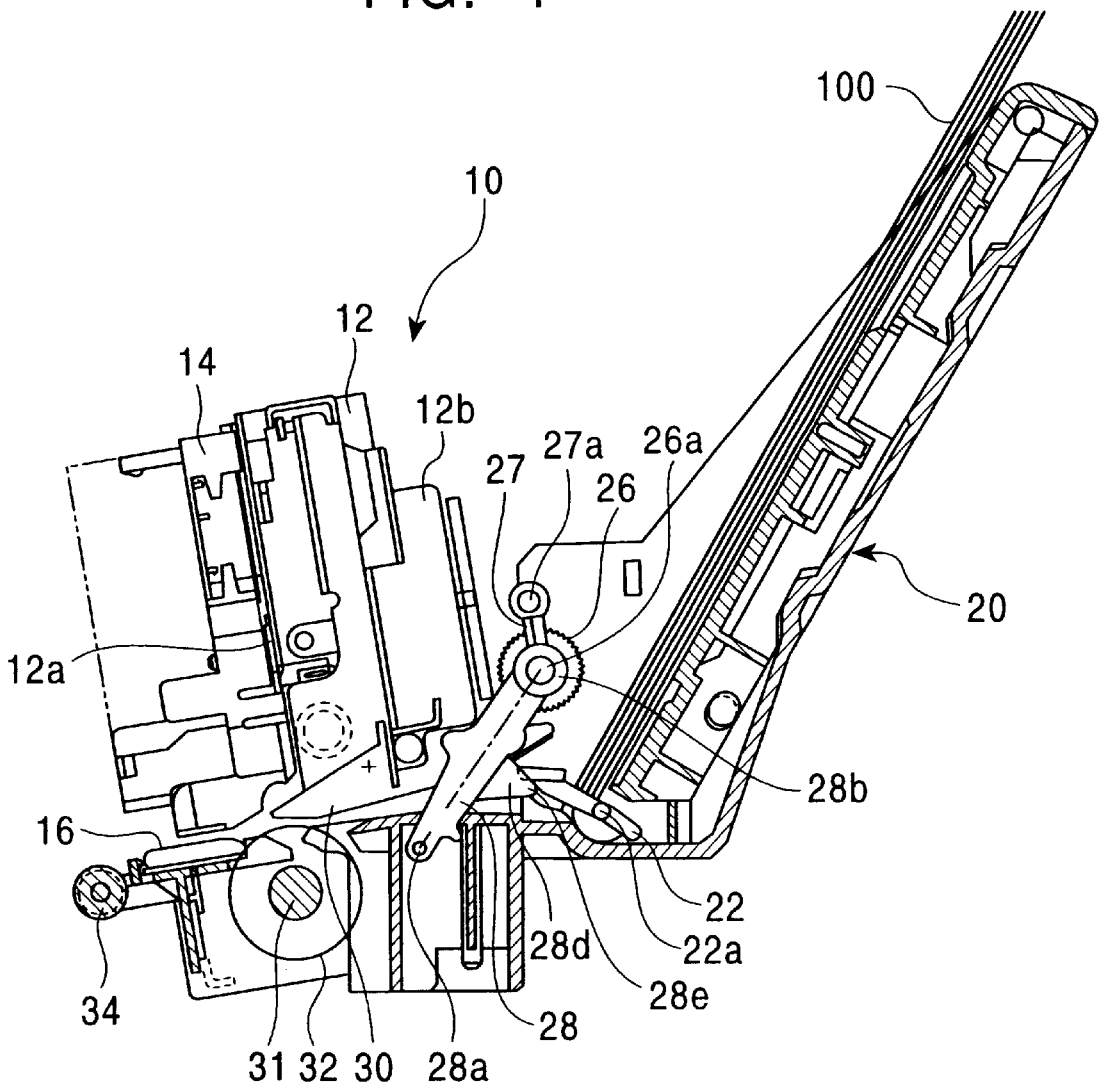
FIG. 4 is a schematic sectional view showing a state in which recording sheets are loaded in the automatic sheet-feeding device.
Figure 5:
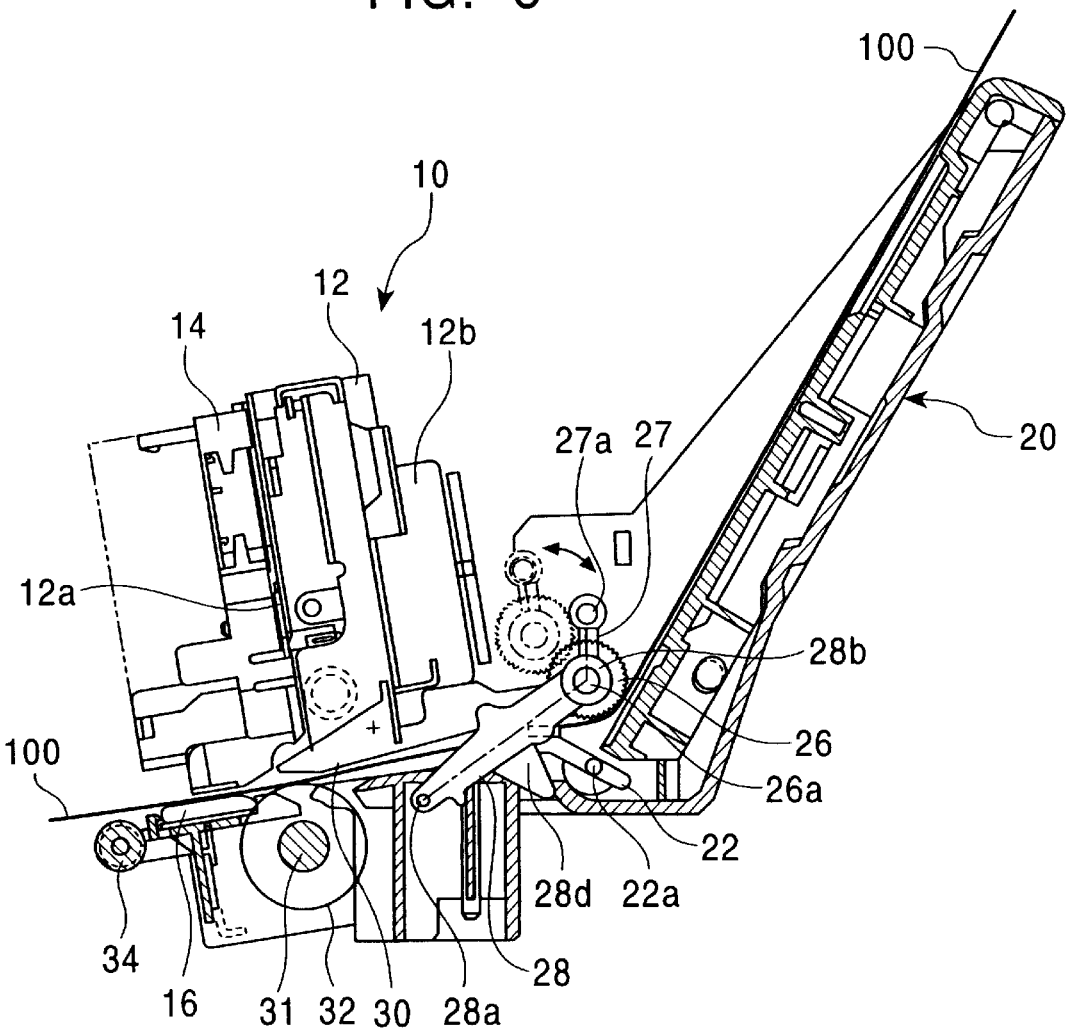
FIG. 5 is a schematic sectional view showing a state in which a recording sheet is being conveyed in the automatic sheet-feeding device.
Figure 6:
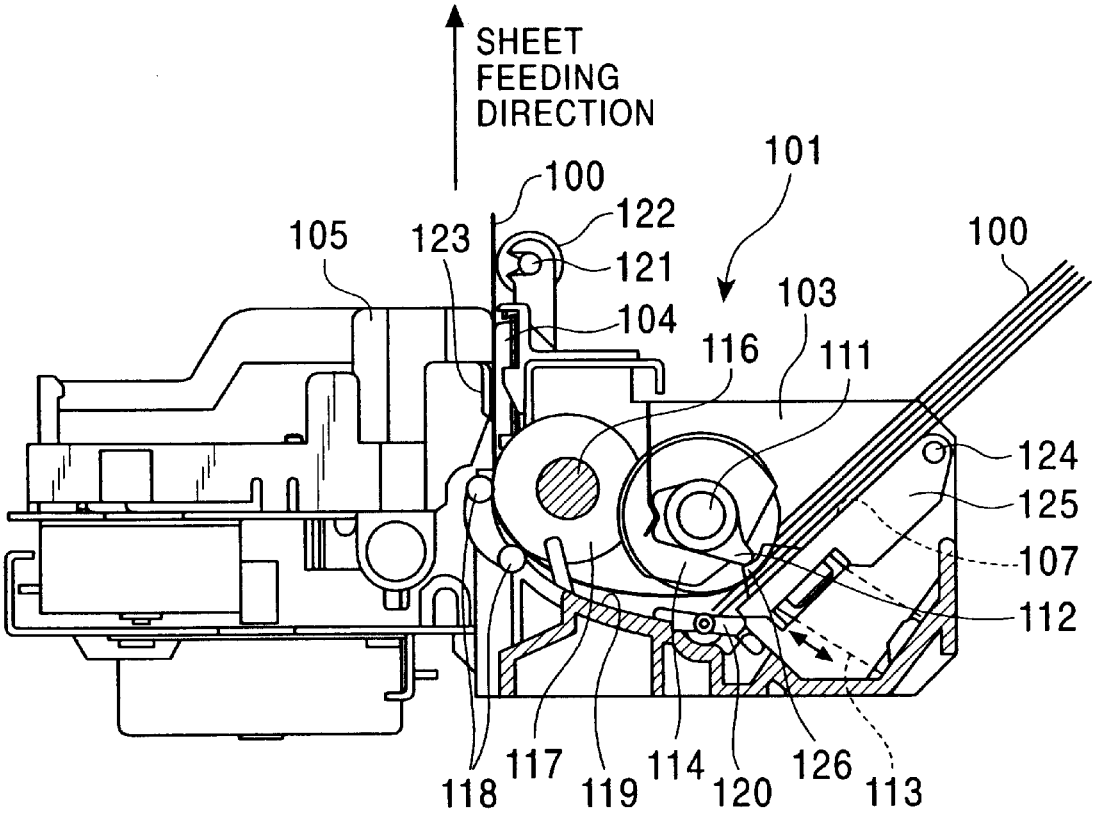
FIG. 6 PRIOR ART
FIG. 6 is a sectional view showing the principal part of a printer to which a conventional automatic sheet-feeding device is applied.

As shown in FIGS. 4 and 5, a lever arm 28 shaped like a rectangular plate is pivotally supported by the printer frame 12 at one end 28*a*, and is linked with the delivery roller driving shaft 26*a* at the other end 28*b*. The lever arm 28 pivots on the one end 28*a* in the direction of arrow in the figure.

The lever arm 28 has, at its center, a retaining portion 28*d* projecting outward, and a leading end portion 28*e* thereof retains a separating plate which will be described later.

At the lower end of the sheet loading section 20 where the rear portion 12*b* of the printer frame 12 and the sheet loading section 20 are connected, a separating plate 22 shaped nearly like a flat plate extends in the widthwise direction of the printer frame 12, and is supported so as to pivot on its shaft 22*a* relative to the sheet loading section 20.

The separating plate 22 is inclined at a predetermined angle to the upper surface of the sheet loading section 20 so that the leading ends of recording sheets 100 placed on the sheet loading section 20 make contact therewith and so that only the uppermost recording sheet 100 is separated. The separating plate 22 is inclined at predetermined angles to the upper surface of the sheet loading section 20 depending on the type, thickness, size, and the like of the recording sheets 100.

When the support shaft 27*a* of the small arm 27 is placed at a distance from the sheet loading section 20 by a driving section (not shown), as shown in FIG. 4, the delivery roller driving shaft 26*a* mounted at one end of the small arm 27 and the delivery rollers 26 are also placed at a distance therefrom. The lower end of the separating plate 22 retained by the leading end portion 28*e* of the retaining portion 28*d* of the lever arm 28 is moved in response to the upward movement of the leading end portion 28*e* so that the separating plate 22 is substantially perpendicular to the surface of the sheet loading section 21, that is, the inclination is decreased to hold the recording sheets 100 (so-called roller up state).

When the support shaft 27*a* of the small arm 27 is placed adjacent to the sheet loading section 20 by the driving mechanism (not shown), as shown in FIG. 5, the delivery roller driving shaft 26*a* mounted at one end of the small arm 27 is also placed adjacent thereto, the delivery rollers 26 make contact with the upper surface of the sheet loading section 20, and the lower end of the separating plate 22 retained by the leading end portion 28*e* of the retaining portion 28*d* of the lever arm 28 is moved in response to the downward movement of the leading end portion 28*e* so that the inclination of the separating plate 22 with respect to the upper surface of the sheet loading section 20 is increased to an obtuse angle (so-called roller down state).

In the printer 10, a feeding roller driving shaft 31 is disposed below the carriage 14 and between the delivery rollers 26 and the platen 16 so as to extend in the widthwise direction of the printer frame 12 and to be supported at both ends of the printer frame 12. A plurality of feeding rollers 32 are mounted on the feeding roller driving shaft 31 at predetermined intervals. A guide plate 30 is also disposed so that a recording sheet 100 supplied from the sheet loading section 20 is led to the feeding rollers 32.

On the downstream side of the platen 16 in the sheet feeding direction, a discharge roller 34 is rotatably supported by the printer frame 12 so as to extend in the widthwise direction of the printer frame 12. The discharge roller 34 serves to discharge a recording sheet 100, which has been subjected to printing, outside.

A description will be given of a series of operations of the printer 10 to which the automatic sheet-feeding device of this embodiment is applied.

Figure 2:
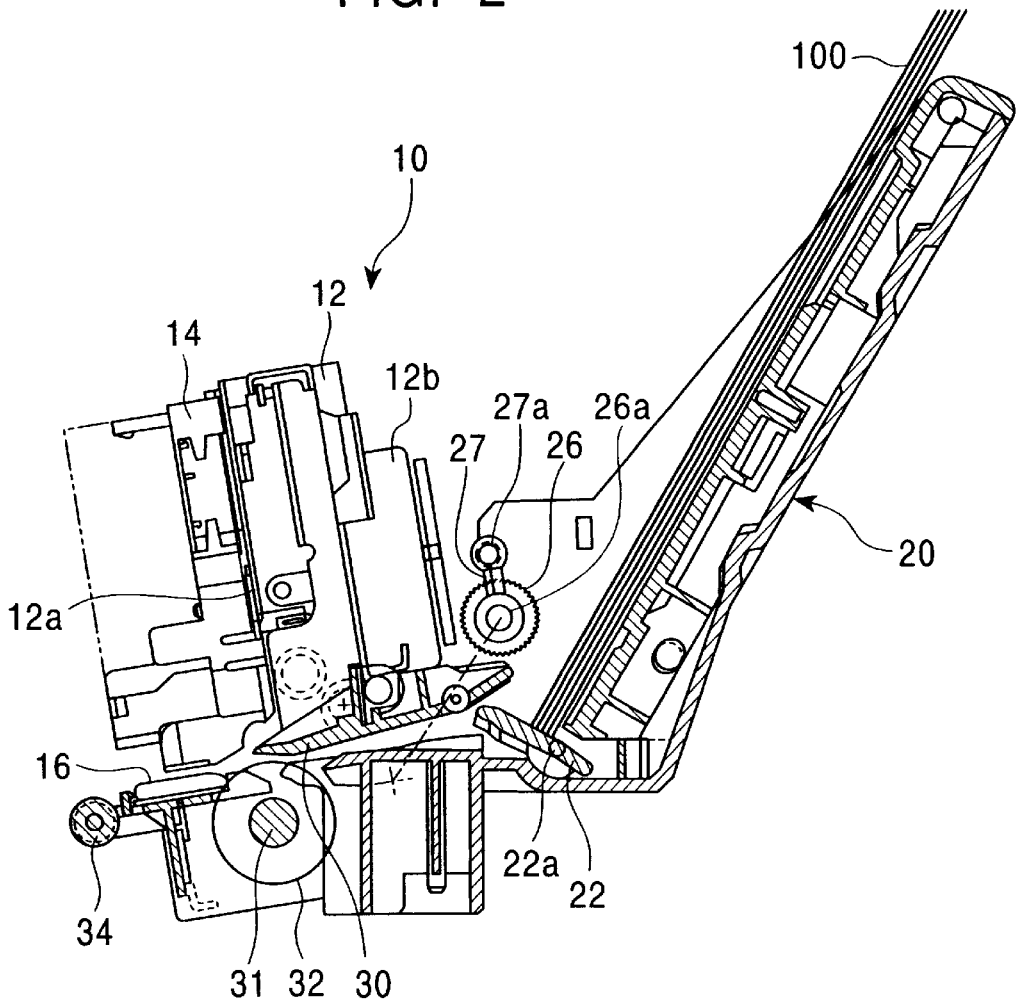
FIG. 2 is a schematic sectional view showing a state in which recording sheets are loaded in the automatic sheet-feeding device.

A method for loading recording sheets 100 in the sheet loading section 20 will now be described with reference to FIGS. 2 and 4. When a plurality of recording sheets 100 are placed in a stacked form on the upper surface of the sheet loading section 20, they move downstream in sliding contact with the sheet loading section 20 because the sheet loading section 20 is placed substantially vertically (is tilted), and the leading ends thereof make contact with the upper surface of the separating plate 22.

Since the delivery rollers 26 are placed at a distance from the sheet loading section 20 and the leading end portion 28*e* of the retaining portion 28*d* of the lever arm 28 lifts and supports the lower end of the separating plate 22, the recording sheet 100 are placed on the sheet loading section 20 while the leading ends thereof are held by the separating plate 22 which is inclined substantially perpendicularly to the sheet loading section 20.

Figure 3:
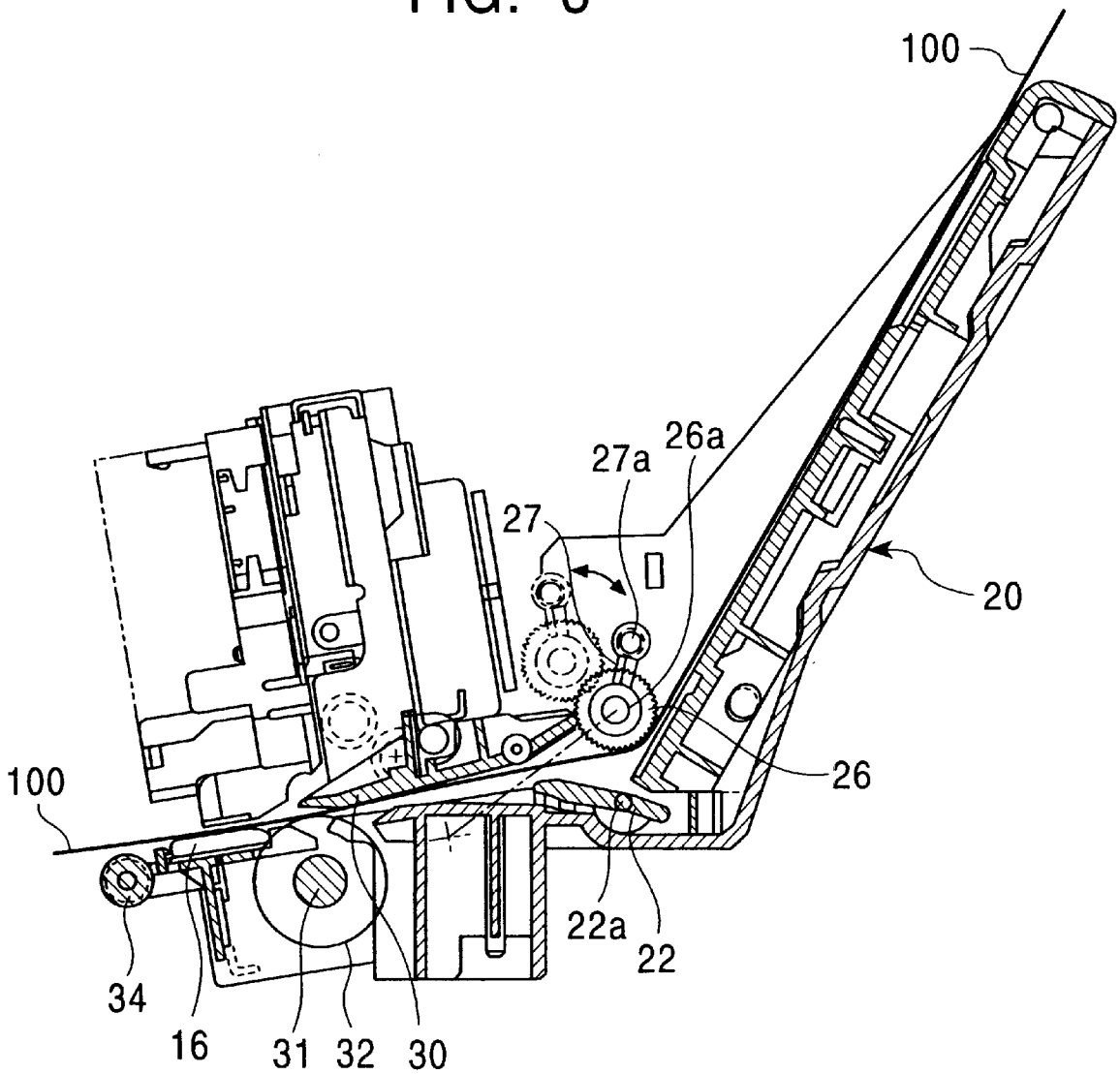
FIG. 3 is a schematic sectional view showing a state in which a recording sheet is being conveyed in the automatic sheet-feeding device.

Next, a method for supplying the recording sheets 100 for printing will be described with reference to FIGS. 3 and 5. In order to supply the recording sheets 100 placed on the upper surface of the sheet loading section 20 into the printer 10, the delivery roller driving shaft 26*a* for the delivery rollers 26 is moved toward the sheet loading section 20 via the small arm 27 by pivoting the lever arm 28 on the one end portion 28*a*. By such pivotal movement of the lever arm 28, the delivery roller driving shaft 26*a* rotatably linked with the other end portion 28*b* of the lever arm 28 is also moved closer to the sheet loading section 20, and the delivery rollers 26 make contact with the uppermost recording sheet 100 placed on the upper surface of the sheet loading section 26. With this, the retaining portion 28*d* of the lever arm 28 moves to the lowermost position, and the lower end of the separating plate 22 retained thereby pivots on the shaft 22*a*. Consequently, the inclination of the separating plate 22 with respect to the sheet loading section 20 is increased.

Subsequently, when the delivery rollers 26 are rotationally driven on the delivery roller driving shaft 26*a,* the uppermost recording sheet 100 is conveyed downstream in the sheet feeding direction along a sheet guide (not shown) for limiting the movement of the recording sheet 100 in the widthwise direction, passes over the separating plate 22 inclined at the above predetermined angle, and is guided under the lower surface of the guide plate 30, so that the leading end thereof is led to the feeding rollers 32. The recording sheets 100 remaining on the upper surface of the sheet loading section 20 are prevented by the separating plate 22 from advancing in the sheet feeding direction and are maintained in a state in which the leading ends thereof are in contact with the separating plate 22.

When the feeding rollers 32 are rotationally driven, the recording sheet 100 is further conveyed to the platen 16 on the downstream side of the feeding rollers 32 while the leading end thereof is held by the lower surface of the guide plate 30. At the time when the leading end of the recording sheet 100 reaches the feeding rollers 32, the delivery rollers 26 are returned to their initial positions apart from the sheet loading section 20. In response thereto, the separating plate 22 is returned to the above initial inclined state in which the recording sheets 100 are loaded.

After the recording sheet 100 is placed between the platen 16 and the thermal head and the leading end thereof protrudes outside from the discharge roller 34, the feeding rollers 32 are reversely rotated to feed back the recording sheet 100 upstream in the sheet feeding direction, thereby cueing up the recording sheet 100 to a printing start position.

A predetermined printing operation is started in such a state in which the recording sheet 100 is placed at the printing start position. That is, in the printer 10, the thermal head is pressed against the platen 16 with the ink ribbon and the recording sheet 100 therebetween, and the heating elements of the thermal head are selectively driven according to printing information while moving the carriage 14 along the platen 16, whereby printing is performed on the recording sheet 100.

With line feeding operations necessary for printing, the feeding rollers 32 are rotated in the sheet feeding direction so as to convey the recording sheet 100.

When printing on the recording sheet 100 is completed, the recording sheet 100 is discharged by rotating the discharge roller 34.

By repeating the above-described operations, the subsequent recording sheets 100 are sequentially subjected to printing.

The automatic sheet-feeding device of the printer 10 having the above configuration for operating in the above manner provides the following advantages:

1) The automatic sheet-feeding device comprises the sheet loading section 20 on which a plurality of recording sheets 100 to be printed can be stacked, the delivery rollers 26 movable closer to and further apart from the recording sheets 100 placed on the upper surface of the sheet loading section 20 so as to supply the recording sheets 100 in the sheet feeding direction, and the separating plate 22 disposed at the lower end of the sheet loading section 20 so as to be in contact with the leading ends of the recording sheets 100 and to separate the uppermost recording sheet 100 one by one. When the recording sheets 100 are loaded on the upper surface of the sheet loading section 20, the delivery rollers 26 are separated from the sheet loading section 20, and the separating plate 22 is inclined substantially perpendicularly to the surface of the sheet loading section 20 so as to hold the recording sheets. Since the separating plate 22 functions as a barrier in the sheet feeding direction, the recording sheets are prevented from being inadvertently inserted from the sheet loading section 20 in the sheet feeding direction serving as an inserting direction, and reliability of loading the recording sheets 100 in the sheet loading section 20 can thereby be improved.

Even when several tens of recording sheets 100 are inserted together in the sheet loading section 20, they do not abut against the surrounding components because space, large enough to hold the recording sheets 100, is ensured between the upper surface of the sheet loading section 20 and the delivery rollers 26. This improves reliability of loading the recording sheets 100.

2) When feeding the recording sheets 100 placed on the upper surface of the sheet loading section 20, the delivery rollers 26 are rotated in contact with the sheet loading section 20 and the inclination of the separating plate 22 with respect to the surface of the sheet loading section 20 is set at the angle that allows the uppermost recording sheet 100 to be separated. Except when the recording sheets 100 are supplied from the sheet loading section 20, for example, during a printing operation, the delivery rollers 26 are separated from the sheet loading section 20, and the recording sheets 100 can be precisely conveyed only by the feeding rollers 32. Moreover, since the separating plate 22 is inclined substantially perpendicularly to the sheet loading section 20 so as to hold the recording sheets 100, the remaining recording sheets 100 are prevented from being supplied. This avoids so-called double feeding in which the recording sheets 100 are supplied while overlapping with each other.

3) The delivery roller driving shaft 26*a* is disposed to rotatably support the delivery rollers 26, and the lever arm 28 is disposed to pivot on the one end portion 28*a* and to support the delivery roller driving shaft 26*a* at the other end portion 28*b*. The lever arm 28 has the retaining portion 28*d* protruding outward for supporting the separating plate 22. In response to the movement of the delivery rollers 26 into contact with the recording sheets 100 on the sheet loading section 20 during a sheet supply operation, the separating plate 22 is inclined at a greater angle via the retaining portion 28*d* of the lever arm 28. Except during the sheet supply operation, the separating plate 22 is inclined at a smaller angle via the retaining portion 28*d* of the lever arm 28 in accordance with the movement of the delivery rollers 26 further apart from the sheet loading section 20. Since this allows the separating plate 22 to automatically adjust its angle of inclination to predetermined angles in accordance with the movement of the delivery rollers 26, troublesome operations and incorrect operations can be avoided.

While the present invention has been described with reference to what is presently considered to be the preferred embodiment, it is to be understood that the invention is not limited to the disclosed embodiment. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An automatic sheet-feeding device of a printer comprising:

a sheet loading section to hold a plurality of stacked recording sheets to be subjected to printing;

a delivery roller movable closer to and further apart from the recording sheets held in said sheet loading section to supply the recording sheets in a sheet feeding direction;

a separating plate disposed at a lower end of said sheet loading section to allow leading edges of the recording sheets to contact therewith and to separate an uppermost recording sheet one by one;

a rotation shaft to rotatably support said delivery roller; and a lever arm pivotally movable on one end to support said rotation shaft at the other end of the lever arm, and having a retaining portion protruding outward to support said separating plate, wherein when said delivery roller is rotationally driven in contact with said sheet loading section, an inclination of said separating plate with respect to a surface of said sheet loading section is made large enough to separate the uppermost recording sheet one by one when the recording sheets held in said sheet loading section are supplied, and when said delivery roller is separated from said sheet loading section, the inclination of said separating plate with respect to the surface of said sheet loading section is made small enough to hold the recording sheets except when the recording sheets are supplied from said sheet loading section, said separating plate is moved in connection with movement of said delivery roller closer to and further apart from said sheet loading section, and said separating plate increases an angle of inclination via said retaining portion of said lever arm in connection with movement of said delivery roller into contact with the recording sheets on said sheet loading section when said delivery roller performs a sheet supply operation, and said separating plate decreases the angle of inclination via said retaining portion of said lever arm in accordance with the movement of said delivery roller further apart from said sheet loading section except during the sheet supply operation.

* * * * *